United States Patent [19]

Carlson

[11] 4,363,251

[45] Dec. 14, 1982

[54] METHOD AND APPARATUS FOR CUTTING BREAD

[75] Inventor: John L. Carlson, Duluth, Minn.

[73] Assignee: Jeno's Inc., Duluth, Minn.

[21] Appl. No.: 165,779

[22] Filed: Jul. 3, 1980

[51] Int. Cl.[3] ..... B26D 3/30

[52] U.S. Cl. ..... 83/105; 83/425.2; 83/437; 83/155; 83/874

[58] Field of Search ..... 83/105, 104, 102.1, 83/102, 155, 425.2, 437, 874

[56] References Cited

U.S. PATENT DOCUMENTS

| | | | |
|---|---|---|---|
| 1,504,130 | 8/1924 | Macbeth et al. | 83/874 |
| 2,247,696 | 7/1941 | Papendick | 83/105 |
| 2,362,126 | 11/1944 | Fry | 83/105 |
| 2,373,500 | 4/1945 | Pearce | 83/105 |

*Primary Examiner*—Donald R. Schran

*Attorney, Agent, or Firm*—Hume, Clement, Brinks, William & Olds, Ltd.

[57] ABSTRACT

A method and apparatus for cutting bread is disclosed. The apparatus includes a conveyor which conveys bread through a positioner to a circular, vertically disposed, rotatably mounted cutting blade. The positioner positions the bread with respect to the cutting blade to control the size and configuration of the pieces of bread cut by the cutting blade. A displacement member separates the upper portions of the cut pieces of bread, thus causing the pieces to separate and drop downwardly with the cut face of each piece of bread facing upwardly.

5 Claims, 6 Drawing Figures

METHOD AND APPARATUS FOR CUTTING BREAD

BACKGROUND AND SUMMARY OF THE INVENTION

This invention relates generally to a method and apparatus for cutting bread. More particularly, the invention relates to a method and apparatus for cutting bread utilizing a circular, substantially vertical, rotatably mounted cutting blade Apparatus for cutting or slicing bread have been in existence for many years. A simple knife is often the easiest and most suitable such apparatus since it gives the operator a great deal of flexibility with respect to the size and configuration of the pieces of bread to be cut. However, a need developed some years ago for automating the cutting operation due to the desire, at least in commercial operations, for providing cut pieces which are of substantially uniform size and configuration. In an attempt to solve this need, automated bread cutters were designed which include a plurality of evenly spaced, reciprocating cutting blades. An uncut loaf of bread is fed into the apparatus which slices the loaf of bread into a plurality of transverse slices of equal thickness.

While this conventional bread slicer is suitable for the slicing of loaves which are immediately packaged, it is not suited for use in conjunction with an automated system for performing subsequent operations on the individual slices of bread. The described apparatus is of little utility if butter or another topping is to be added to the individual slices because the loaf is retained in compression as a unit, with adjacent slices in direct contact with one another. In order to add such toppings, the loaf must be manually separated, and the slices laid out in a horizontal position.

Other disadvantages in conventional bread cutters result from the reciprocating motion of the cutting blades. First, the reciprocating blades are ordinarily serrated. This causes a cut which can be rough or jagged with some types of bread. Second, the drive mechanism for reciprocating blades is often relatively complex despite the simplicity of the cutting operation being performed. Third, reciprocating, serrated blades often have difficulty in cutting through frozen bread. Thus, the apparatus lacks versatility which could, in some applications, be a serious limitation.

Accordingly, it is an object of the present invention to provide a method and apparatus for cutting bread which effectively and reliably overcomes the aforementioned drawbacks and limitations of the proposals in the prior art.

The invention responds to the problems in the prior art by providing an apparatus which utilizes a substantially circular, vertically disposed, rotatable cutting blade. First conveying means is provided for conveying bread toward the cutting blade. Positioning means position the bread with respect to the cutting blade to control the size and configuration of the pieces of bread cut by the cutting blade. In one preferred embodiment this positioning means confines the outer periphery of the bread to center the bread with respect to the cutting blade, thereby bisecting the bread into two substantially equal pieces. Displacement means are also provided which separate the upper portions of the cut pieces of bread, causing the pieces to drop downwardly with the cut face of each piece of bread facing upwardly. Second conveying means are normally also provided which receive the cut pieces of bread from the displacement means, and convey them away from the cutting blade.

These and other objects, features and advantages of the present invention will be apparent from the following description, appended claims and annexed drawings.

DETAILED DESCRIPTION OF THE PREFERRED EMBODIMENTS

Figure 1:
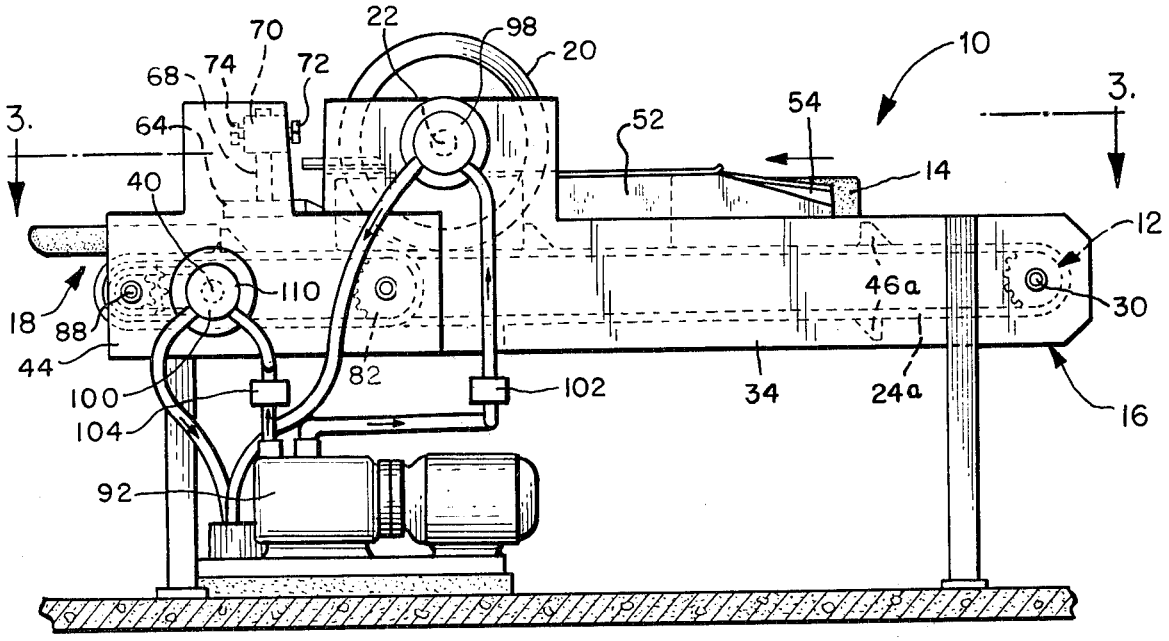
FIG. 1 is a side elevation view of one embodiment of the present invention.

In that form of the invention chosen for purposes of illustration in the drawings, the bread cutting apparatus is generally indicated by the numeral 10. As shown best in FIG. 3, the apparatus 10 normally includes a plurality of work stations, identified as 12 and 12', each of which is intended to cut a separate piece or loaf of bread 14 or 14'. The preferred arrangement is to include three such work stations in the apparatus 10, but any other number of work stations may be included. Since the work stations are normally identical in construction and operation, only a single such station 12 will be described. Corresponding portions of work station 12' are identified in FIG. 3 with primed identification numerals.

Each work station of the apparatus 10 includes upstream and downstream ends 16 and 18, respectively. A rotatably mounted, vertically disposed, circular cutting blade 20 divides the upstream and downstream ends. The cutting blade 20 is driven by a cutting blade drive shaft 22 through a suitable drive mechanism to be described in detail below. The cutting blade 20 is normally constructed of stainless steel and has a sharpened, preferably toothless, edge. In the depicted embodiment the cutting blade 20 rotates in a clockwise direction as seen from FIGS. 2 and 4, with its leading or upstream edge moving downwardly.

Figure 3:
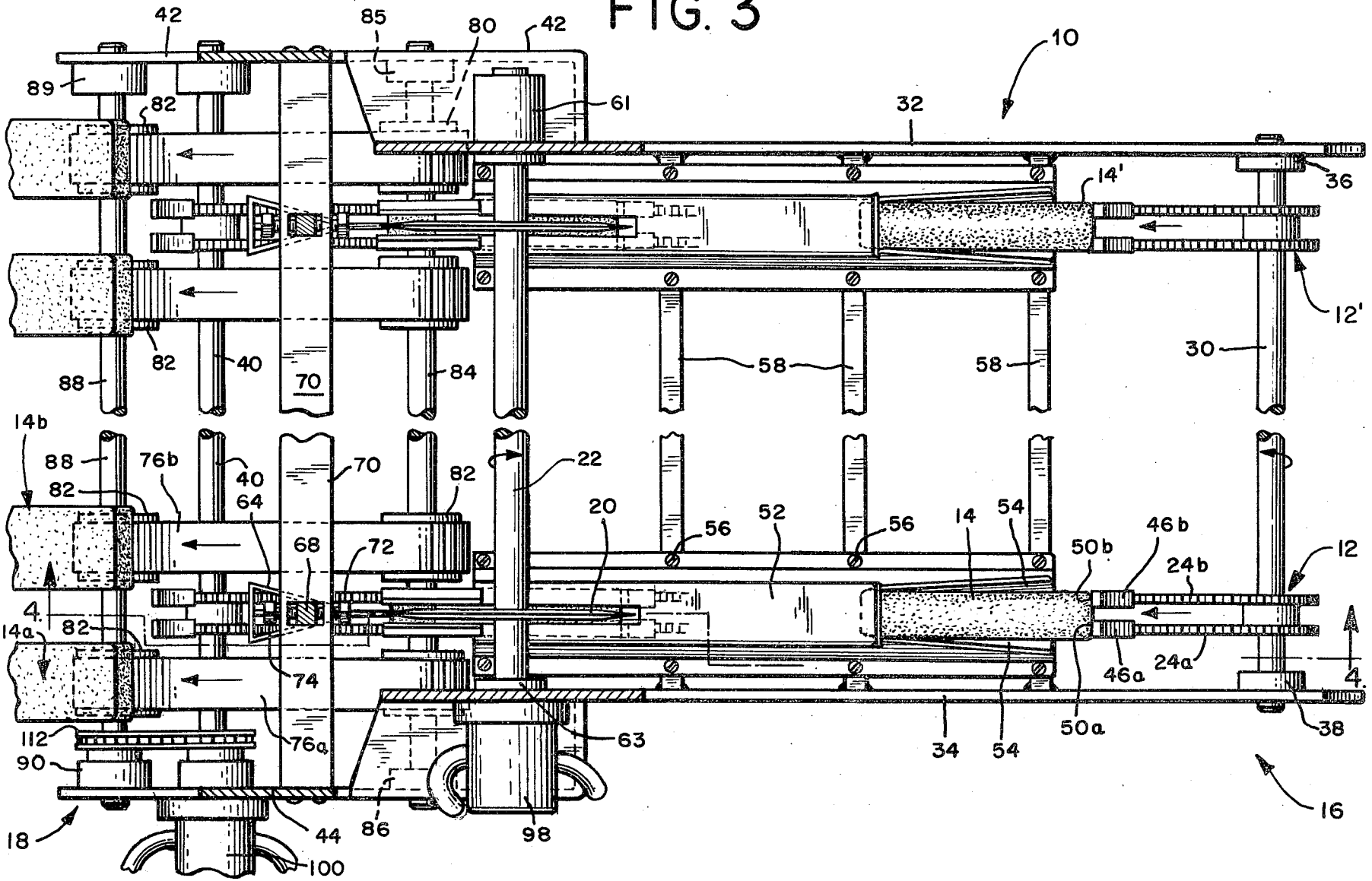
FIG. 3 is a plan view taken along line 3—3 of FIG. 1.

The apparatus 10 also includes means to convey the bread 14 to the cutting blade 20. These means normally include two parallel conveyor chains **24*a* and 24*b* mounted between aligned conveyor chain sprockets 26 and 28. Each of the conveyor chain sprockets 26 and 28 comprise twin sprockets, adapted to receive the two conveyor chains 24*a* and 24*b*. The upstream conveyor chain sprocket 26 is mounted to a conveyor chain idler shaft 30 which extends across the apparatus 10. The conveyor chain idler shaft 30 is rotatably mounted to side plates 32 and 34 of the apparatus 10 within bearings 36 and 38. The downstream conveyor chain sprocket 28 is mounted to a conveyor chain drive shaft 40 which extends across the apparatus 10 between extensions 42 and 44 of the side plates 32 and 34. As shown in FIG. 3, these side plate extensions 42 and 44 are disposed outwardly with respect to side plates 32 and 34 to provide additional space for the drive mechanisms and other components located adjacent the downstream end 18 of the apparatus 10**.

Figure 4:
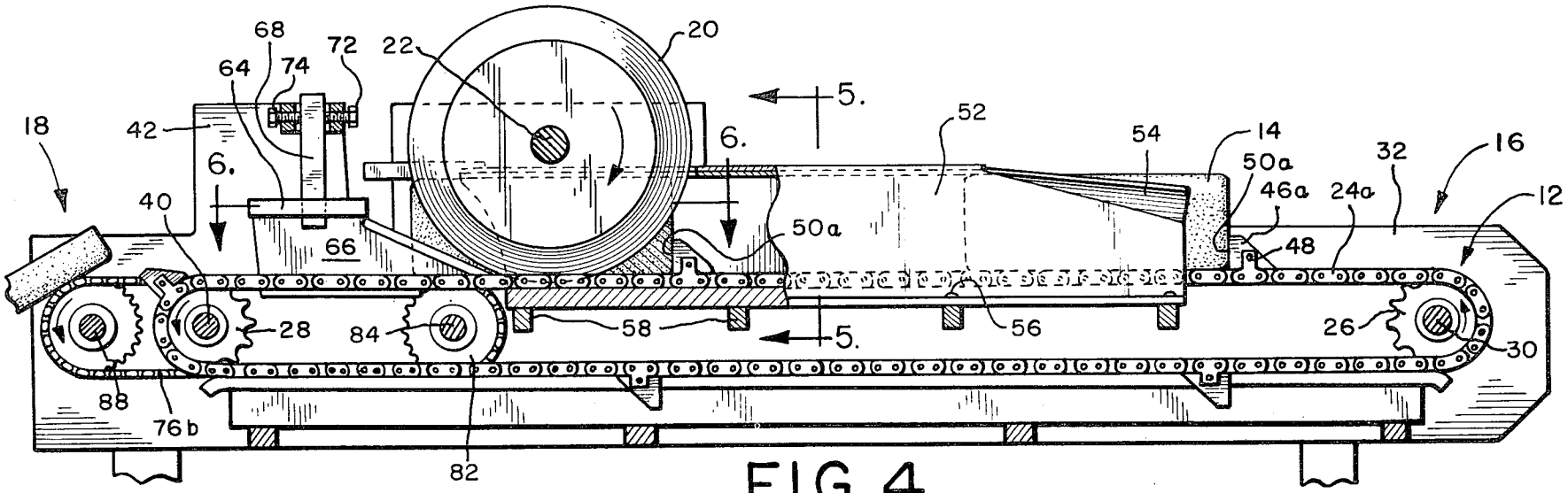
FIG. 4 is a partially-sectioned side elevation view of the embodiment of FIG. 1.

Each of the conveyor chains 24*a* and 24*b* includes a plurality of evenly spaced stops 46*a* and 46*b*. The stops 46*a* and 46*b* are mounted to extended chain links 48 and include substantially vertical forward surfaces 50*a* and 50*b*. The stops 46*a* and 46*b* are designed to convey the bread 14 downstream through the apparatus 10 to the cutting blade 20. As shown in FIG. 4, the stops 46*a* and 46*b* are then returned upstream via the underside of the apparatus 10 by the conveyor chains 24*a* and 24*b*.

A guide channel 52 is positioned upstream of the cutting blade 20 to receive the bread 14 and guide it, with the assistance of the stops 46*a* and 46*b*, toward the cutting blade 20. The guide channel 52 includes flared portions 54 adjacent its upstream end in order to ease insertion of bread 14 into the guide channel 52 by the operator.

The guide channel 52 is mounted by screws 56 to transverse support members 58 which, in turn, extend between and are securely fastened to the side plates 32 and 34. Also mounted to the transverse support members 58 is a conveyor chain guide 60. The conveyor chain guide 60 is positioned within the lower portion of the guide channel 52 and is designed to guide the conveyor chains 24*a* and 24*b* and assist in supporting the bread 14 as it is conveyed downstream toward the cutting blade 20. In the illustrated embodiment both conveyor chains 24*a* and 24*b* and the conveyor chain guide 60 are constructed of a plastic material so that the chains 24*a* and 24*b* glide smoothly over the guide 60 without lubricant. In practice, however, a steel chain may also be used and reduced friction achieved by making only the guide 60 of plastic.

Figure 5:
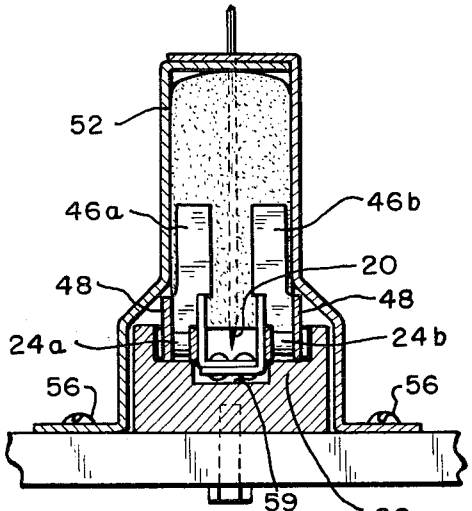
FIG. 5 is sectional end elevation view taken along line 5—5 of FIG. 4.

FIG. 5 depicts the relative position of the bread 14 and the stops 46*a* and 46*b* within the guide channel 52. The stops 46*a* and 46*b* should be symmetrically positioned with respect to the longitudinal centerline of the bread 14, to ensure that the pushing force on the bread 14 is centered. The bread 14 is preferably of such size and shape that its two sides brush against the sides of the guide channel 52 as it is conveyed toward the cutting blade 20. This feature, along with the fact that the guide channel 52 is centered with respect to the cutting blade 20, enables the cutting blade 20 to evenly bisect the bread 14.

The guide channel 52 includes a centered, longitudinal slot 59 in the upper surface of its downstream end. This slot 59 is adapted to receive the cutting blade 20. The downstream end of the guide channel 52 also includes two substantially horizontal angle irons 62 which extend in close proximity to and parallel with the cutting blade 20. These angle irons 62 are adapted to prevent the cut pieces of bread, identified as 14*a* and 14*b*, from following the downstream edge of the cutting blade 20 upward as they are pushed from the guide channel 52 by the stops 46*a* and 46*b*.

As mentioned above, the circular cutting blade 20 is mounted to a cutting blade drive shaft 22. This cutting blade drive shaft 22 extends across the apparatus 10 between the side plates 32 and 34. It is rotatably mounted to the side plates 32 and 34 by bearings 61 and 63.

Figure 2:
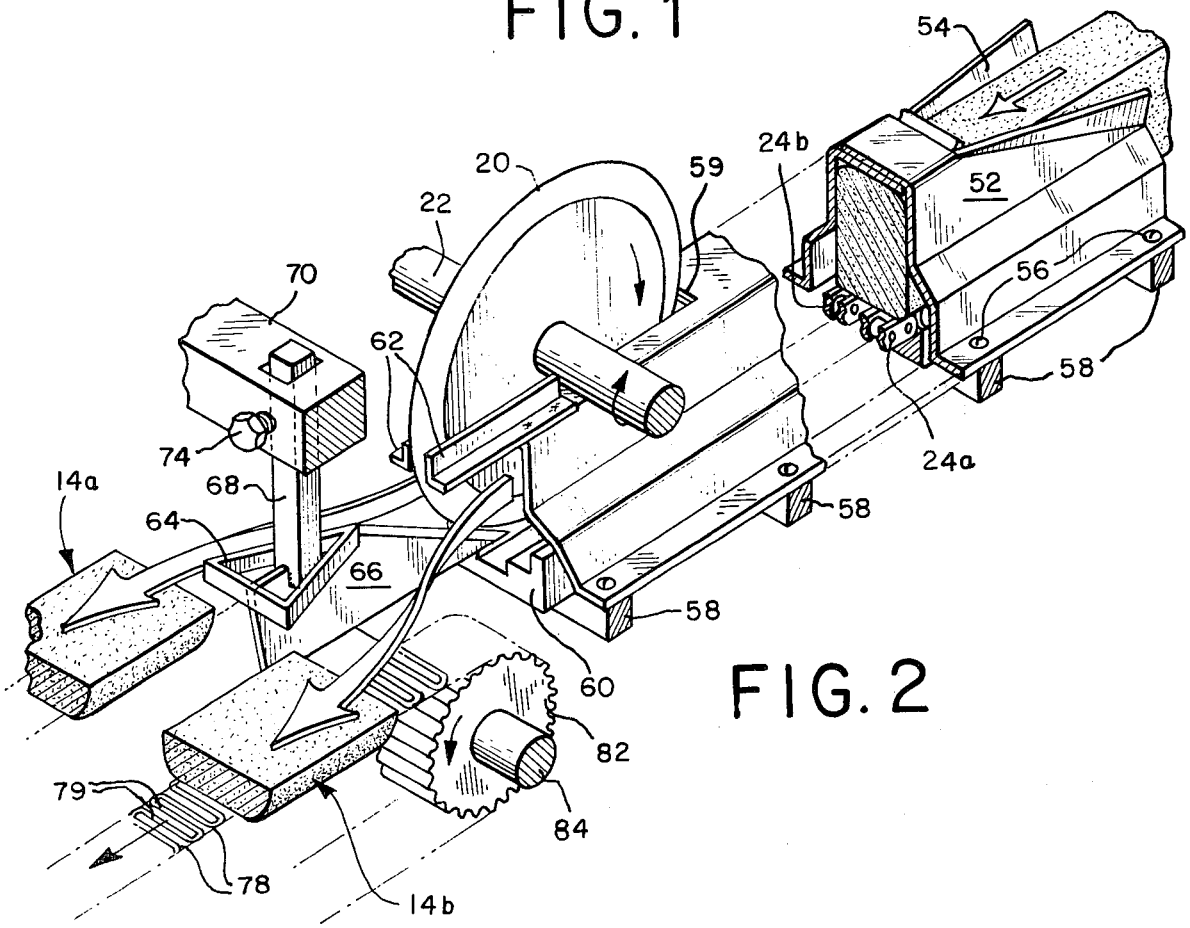
FIG. 2 is a partially-sectioned perspective view of some of the components of the embodiment of FIG. 1, depicting the passage of bread through the apparatus.

Positioned immediately downstream of the cutting blade 20 are means for displacing the pieces of bread 14*a* and 14*b* outwardly. In the depicted embodiment such means include a wedge-shaped, substantially horizontal displacement member 64, and a substantially vertical separator plate 66. The wedge-shaped displacement member 64 is mounted in alignment with the upper portion of the guide channel 52 so that it will contact the upper part of the cut surfaces of the pieces of bread 14*a* and 14*b*, and thereby cause the pieces to drop downwardly and outwardly as depicted in FIG. 2. The separator plate 66 bisects the wedge-shaped displacement member 64 and extends downwardly and in an upstream direction. The separator plate 66 is parallel to and aligned with the cutting blade 20 so that the pieces of bread 14*a* and 14*b* pass to opposite sides of the separator plate 66. The separator plate 66 thus acts to position the pieces of bread 14*a* and 14*b* prior to the point at which they contact the wedge-shaped displacement member 64.

The wedge-shaped displacement member 64 and the separator plate 66 are mounted to a support column 68 which extends downwardly from a transverse beam 70. This transverse beam 70 is mounted between the side plate extensions 42 and 44. The transverse beam 70 thus provides an additional means to tie the apparatus 10 together while providing means from which components of the apparatus 10 may depend. It is preferable that the support column 68 be adjustable with respect to the transverse beam 70. In the depicted embodiment both the height and the linear position of the support column 68 are adjustable, thus providing adjustability to the position of the wedge-shaped displacement member 64 and the separator plate 66. The support column 68 is mounted to the transverse beam by two set screws 72 and 74. In order to adjust the height of the support column 68. The set screws 72 and 74 are loosened, the support column 68 is raised, and the set screws 72 and 74 are retightened. To adjust the linear position of the support column 68, one set screw is turned out (loosened) and the other is turned in (tightened). This will move the support column 63 in the direction of the set screw which is being turned out or loosened.

This linear adjustment is desirable to permit the wedge-shaped displacement member 64 to be adjusted forward or in an upstream direction for bread which is not frozen. The wedge-shaped member 64 is moved to a rearward position when frozen or other rigid bread is being cut to minimize the possibility of breakage of the pieces of bread 14*a* or 14*b*. That is, it can be seen in FIG. 6 that the wedge-shaped displacement member 64 is beginning to separate the downstream end of the pieces of bread 14*a* and 14*b* while the upstream ends are still within the guide channel 52. This causes a certain amount of torsional stress on the pieces of bread 14*a* and 14*b*. With the wedge-shaped displacement member 64 in its rearward-most position, this stress will be less than with the wedge-shaped member in its forward-most position. While torsional stresses present no real problem with soft, unfrozen bread, there could be a potential difficulty with frozen bread if the wedge-shaped displacement member 64 was positioned too close to the cutting blade 20.

Two conveyor belts 76*a* and 76*b* are positioned downstream of the cutting blade 20, laterally outward with respect to the wedge-shaped displacement member 64. These conveyor belts 76*a* and 76*b* are positioned to receive the upward-facing pieces of bread 14*a* and 14*b* after they leave the guide channel 52 and are outwardly displaced by the wedge-shaped displacement member 64. The conveyor belts 76*a* and 76*b* then convey the cut pieces of bread 14*a* and 14*b* downstream away from the cutting blade 20 so that additional preparation operations can be performed.

The conveyor belts 76*a* and 76*b* are preferably constructed of a plurality of parallel ribs 78 with links 79 therebetween. The individual ribs 78 are normally of a length which approximates the width of the cut pieces of bread 14*a* and 14*b*, and may be even longer in order to minimize the possibility of dislodgement of the pieces of bread 14*a* and 14*b* from the conveyor belts 76*a* and 76*b*.

Each of the conveyor belts 76*a* and 76*b* extend between upstream and downstream conveyor belt sprockets 80 and 82, respectively. The upstream sprockets 80 are mounted to a conveyor belt idler shaft 84 which extends between the side plate extensions 42 and 44. Bearings 85 and 86 mount the conveyor belt idler shaft 84 to the side plate extensions 42 and 44 to permit the conveyor belt idler shaft 84 to freely rotate. The downstream conveyor belt sprockets 82 are mounted to a conveyor belt drive shaft 88 which extends between and is rotatably mounted to the side plate extensions 42 and 44 by bearings 89 and 90.

The preferred mechanisms for driving the various moving parts of the apparatus 10 will now be described. As shown in FIG. 1, the apparatus 10 includes an electric motor driven hydraulic pump 92. A conventional variable speed fluid motor 98 is connected to one end of the cutting blade drive shaft 22. The motor 98 is mounted on the apparatus 10 frame as illustrated. Another conventional variable speed fluid motor 100 is connected to one end of the shaft 40. The motor 100 is also mounted on the apparatus 10 frame as illustrated.

The motors 98 and 100 are driven by the output of the pump 92 in a conventional manner. The motors are independently variable as to their output speed. Their output speed is controlled through conventional flow control devices 102 and 104, respectively. As a result the rotating speed of the cutting blade 20 and the travel speed of the conveyor can be separately varied quite easily.

FIG. 3 shows the conveyor belt drive chain 112 which is mounted between sprockets on the conveyor chain drive shaft 40 and the conveyor belt drive shaft 88. The conveyor belt drive chain 112 thus ensures that the conveyor chains 24*a* and 24*b* and the conveyor belts 76*a* and 76*b* are driven in the same direction and at the same speed so that bread will be fed into and removed from the cutting blade 20 at the same rate of speed.

The operation of the apparatus 10 will now be described. Since the apparatus 10 normally includes a plurality of work stations 12 and 12', bread 14 (or 14') can be fed into each such station. However, since the operation of the various stations is identical, the operation of only one station 12 will be described.

Bread 14 is manually fed into the apparatus 10 by inserting it into the upstream end of the guide channel 52, where it will take a straddling position over the conveyor chains 24*a* and 24*b*. The flared portions 54 in the upstream end of the guide channel 52 ease this insertion operation. The bread 14 should be held in place within the guide channel 52 until a pair of stops 46*a* and 46*b* on the conveyor chains 24*a* and 24*b* come into contact with the upstream end of the bread 14. The bread 14 will thus be positively conveyed through the guide channel 52 by the conveyor chain stops 46*a* and 46*b*. Once the bread 14 is conveyed into the guide channel 52, the operator then positions a second loaf or piece of bread 14 in the guide channel 52 until the next pair of stops 46*a* and 46*b* comes into abuttment with the upstream end of the bread 14. At the same time, the operator or another operator will be inserting bread into the guide channels 52' of the other work stations(s) 12'.

As shown in FIG. 5, the stops 46*a* and 46*b* provide a balanced or symmetrical drive force on the bread 14 to prevent jams or other difficulties. Since the configuration of the guide channel 52 corresponds to that of the bread 14, the bread 14 will be centered within the guide channel 52. The bread 14 is supported through the guide channel 52 by the conveyor chain guide 58 which immediately underlies the conveyor chains 24*a* and 24*b*.

Cutting begins as soon as the bread 14 comes into contact with the rapidly rotating cutting blade 20. The downward force on the bread 14 by the cutting blade 20 is absorbed by the conveyor chain guide 58. Upon passing through the cutting blade 20 the bread 14 is cut into two pieces 14*a* and 14*b*. These pieces 14*a* and 14*b* continue to be conveyed downstream by the stops 46*a* and 46*b*, respectively. Since a gap exists between the stops 46*a* and 46*b*, they will not come into contact with the cutting blade 20 which passes between them.

Figure 6:
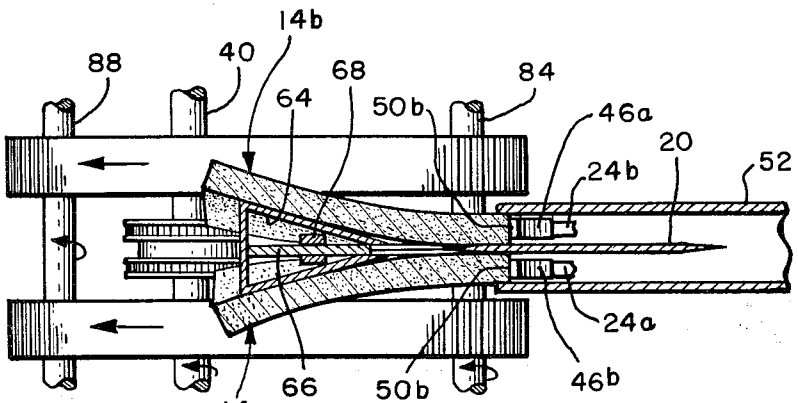
FIG. 6 is a sectional plan view taken along line 6—6 of FIG. 4.

As shown best in FIGS. 2 and 6, after being cut the pieces of bread 14*a* and 14*b* pass to opposite sides of the separator plate 66 prior to coming into contact with the wedge-shaped displacement member 64. The wedge-shaped displacement member 64 is positioned to contact the upper portion of the cut faces of the pieces of bread 14*a* and 14*b*, thereby causing the bread pieces 14*a* and 14*b* to be tilted downwardly as the stops 46*a* and 46*b* continue to push them in a downstream direction. When the upstream ends of the bread pieces 14*a* and 14*b* emerge from the guide channel 52, the bread pieces 14*a* and 14*b* drop downwardly and outwardly onto the conveyor belts 76*a* and 76*b*, respectively. The conveyor belts 76*a* and 76*b* then convey the bread pieces 14*a* and 14*b* out of the bread cutting apparatus 10. Since the cut surfaces of the bread pieces 14*a* and 14*b* face upwardly, they are in position for the automated deposit of toppings thereon, if such is necessary or desirable.

Of course, it should be understood that various changes and modifications of the preferred embodiments described herein will be apparent to those skilled in the art. Such changes and modifications can be made without departing from the spirit and scope of the present invention and without diminishing its attendant advantages. It is therefore intended that such changes and modifications be covered by the following claims.

I claim:

1. An apparatus for cutting a loaf of bread, comprising:

(a) a circular cutting blade mounted on an axis for rotation in a substantially vertical plane;

(b) a first conveying means for conveying the loaf of bread from upstream of said cutting blade to downstream of said blade in a direction substantially perpendicular to said axis;

(c) a channel upstream of said blade and extending into cooperating relationship with said blade for guiding the loaf of bread as it is conveyed to said cutting blade whereby the one piece loaf is cut through vertically on its centerline into only two pieces of bread by said cutting blade;

(d) said channel confining the outer periphery of said loaf while said cutting blade cuts it into two pieces and enclosing the major portion of said blade below said shaft;

(e) a second conveying means extending in the same direction as said first conveying means for receiving said two pieces and conveying them downstream of said blade away from said blade; and (f) bread piece displacement means downstream of said blade;

(g) said bread piece displacement means including means which engage the upper portion of each of said pieces of bread and cause the pieces of bread to separate and drop downwardly onto said second conveying means with the cut face of each piece of bread facing upwardly.

2. The apparatus of claim 1 further characterized in that:

(a) said guiding means confines the outer periphery of said loaf while said cutting blade cuts it into two pieces.

3. The apparatus of claim 2 further characterized in that:

(a) said guiding means comprises a channel which extends parallel to the direction in which said first conveying means moves the bread;

(b) said channel enclosing the major portion of said blade below said shaft.

4. The apparatus of claim 1 further characterized in that:

(a) said displacement means includes a stationary, wedge-shaped member which, when it is engaged by the upper portions of each of said pieces of bread, forces these upper portions apart.

5. The apparatus of claim 4 further characterized in that:

(a) said channel includes parallel guide members which extend downstream of said axis in close proximity to said cutting blade and prevent the cut pieces of bread from following the downstream of the cutting blade upwardly as they are pushed from the guide channel by said first conveyor means.

* * * * *